US008523624B2

(12) United States Patent
Kanao et al.

(10) Patent No.: US 8,523,624 B2
(45) Date of Patent: Sep. 3, 2013

(54) SPARK PLUG FOR INTERNAL COMBUSTION ENGINE AND MANUFACTURING METHOD THEREOF

(75) Inventors: Keiji Kanao, Chita-gun (JP); Ken Hanashi, Handa (JP); Kenka Tsubota, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/553,843

(22) Filed: Jul. 20, 2012

(65) Prior Publication Data

US 2012/0289115 A1 Nov. 15, 2012

Related U.S. Application Data

(62) Division of application No. 11/336,876, filed on Jan. 23, 2006, now Pat. No. 8,258,686.

(30) Foreign Application Priority Data

Jan. 26, 2005 (JP) ..... 2005-018013

(51) Int. Cl.
*H01T 21/02* (2006.01)

(52) U.S. Cl.
USPC ..... 445/7; 313/141; 313/142; 313/143

(58) Field of Classification Search
USPC ..... 313/141–143; 445/7; 123/143, 123/169 R, 123, 169 EL, 310, 32, 41
See application file for complete search history.

(56) References Cited

U.S. PATENT DOCUMENTS

| | | | | |
|---|---|---|---|---|
| 4,109,633 | A | 8/1978 | Mitsudo et al. | |
| 5,952,770 | A | 9/1999 | Mueller et al. | |
| 6,316,868 | B1 | 11/2001 | Ishino et al. | |
| 6,533,628 | B1 | 3/2003 | Matsutani | |
| 6,707,237 | B2 | 3/2004 | Teramura et al. | |
| 7,250,711 | B2 * | 7/2007 | Koyama et al. | 313/141 |
| 2004/0129683 | A1 | 7/2004 | Torii et al. | |
| 2005/0067933 | A1 | 3/2005 | Kato | |
| 2005/0168121 | A1 | 8/2005 | Tinwell | |
| 2006/0163992 | A1 | 7/2006 | Kanao et al. | |

FOREIGN PATENT DOCUMENTS

| | | | |
|---|---|---|---|
| JP | 52-36237 | | 3/1977 |
| JP | 60-133684 | | 7/1985 |
| JP | 11-510958 | | 9/1999 |
| JP | 2000-34969 | A | 2/2000 |
| JP | 2001-015245 | A | 1/2001 |
| JP | 2002-237370 | A | 8/2002 |
| JP | 2004-22450 | A | 1/2004 |
| JP | 2004-022450 | A | 1/2004 |
| JP | 2004-158220 | A | 6/2004 |

OTHER PUBLICATIONS

Japanese Office Action dated Oct. 6, 2009, issued in corresponding Japanese Application No. 2005-018013, with English translation.

* cited by examiner

*Primary Examiner* — Anh T. Mai
*Assistant Examiner* — Elmito Breval
(74) *Attorney, Agent, or Firm* — Nixon & Vanderhye PC

(57) ABSTRACT

A spark plug includes a tubular metal shell, an insulator, a cylindrical center electrode, and a ground electrode. The ground electrode has an inclined portion, a straight portion, and a bend between the inclined and straight portions. The inclined portion extends obliquely with respect to the axial direction of the center electrode from a base end of the ground electrode, which is joined to an end of the metal shell, to the bend that is positioned closer to the center electrode in the radial direction of the center electrode than the base end. The straight portion extends substantially parallel to the axial direction of the center electrode from the bend to a tip end of the ground electrode. The straight portion has an inner side surface facing the side surface of an end portion of the center electrode through a spark gap in the radial direction of the center electrode.

6 Claims, 9 Drawing Sheets

SPARK PLUG FOR INTERNAL COMBUSTION ENGINE AND MANUFACTURING METHOD THEREOF

CROSS-REFERENCE TO RELATED APPLICATION

This application is a Division of application Ser. No. 11/336,876, filed Jan. 23, 2006, which is based on and claims priority from Japanese Patent Application No. 2005-18013, filed on Jan. 26, 2005, the content of which is hereby incorporated by reference into this application.

BACKGROUND OF THE INVENTION

1. Technical Field of the Invention

The present invention relates generally to spark plugs for use in internal combustion engines of automotive vehicles and cogeneration systems.

More particularly, the invention relates to a spark plug for an internal combustion engine which has a capability to reliably induce and detect an ion current within a combustion chamber of the engine, and a method of manufacturing such a spark plug.

2. Description of the Related Art

FIG. 12 shows an existing spark plug 9 for use in an internal combustion engine, for example, of an automotive vehicle. As shown in the figure, the spark plug 9 includes an insulator 92, a cylindrical center electrode 93, a tubular metal shell 94, and a pair of ground electrodes 95.

The center electrode 93 is secured in the insulator 92 and has a protruding portion 932 that protrudes from an end 921 of the insulator 92. The insulator 92 is retained in the metal shell 94 such that the end 921 thereof protrudes from an end 941 of the metal shell 94. Each of the ground electrodes 95 has a base end 952, which is joined to the end 941 of the metal shell 94 by, for example, welding, and a tip end 951 that faces the side surface of an end portion 931 of the protruding portion 932 of the center electrode 93 through a spark gap 91 in the radial direction of the center electrode 93.

Such a spark plug 9 is generally used to ignite the air/fuel mixture within a combustion chamber of the internal combustion engine. In addition, the spark plug 9 may also be used, as disclosed in Japanese Patent First Publications No. 2000-34969 and No. 2004-22450, to induce and detect an ion current within the combustion chamber of the engine for the purpose of increasing the output and improving the fuel economy of the engine.

Specifically, during combustion of the air/fuel mixture within the combustion chamber of the engine, positive and negative ions are created due to ionization of the air/fuel mixture. The positive and negative ions are absorbed by the corresponding electrodes of the spark plug 9, thereby inducing the ion current that flows between the center electrode 93 and the ground electrodes 95. Through detecting the ion current, it is possible to determine the combustion pressure, the occurrence of a misfire, and other parameters and events relating to the combustion.

However, with running of the engine, the surface of the protruding portion 932 of the center electrode 93 is gradually fouled with combustion residues, such as carbon, thereby reducing the "effective area" of the surface. The effective area of the surface here denotes an area of the surface which is not fouled with combustion residues and thus can absorb ions to induce the ion current.

To enable the effective area of the surface of the protruding portion 932 of the center electrode 93 to be sufficiently large, the Japanese Patent First Publication No. 2004-22450 discloses a spark plug, in which the end face area of the tip end 951 of each of the ground electrodes 95 is specified to be in a given range, so as to effectively burn-off, by spark discharges, the combustion residues that have deposited on the surface of the protruding portion 932.

However, with such a spark plug, it is still difficult to effectively burn-off in a sufficiently wide range the combustion residues, and thus it is still difficult to reliably induce and detect the ion current within the combustion chamber of the engine.

SUMMARY OF THE INVENTION

It is, therefore, an object of the present invention to overcome the above-mentioned problems accompanying the existing spark plugs.

It is another object of the present invention to provide a spark plug for an internal combustion engine, which has a capability to effectively burn-off the combustion residues that have deposited on a center electrode of the spark plug, and a manufacturing method thereof.

It is a further object of the present invention to provide a spark plug for an internal combustion engine, which has a capability to reliably induce and detect an ion current within a combustion chamber of the engine, and a manufacturing method thereof.

According to one aspect of the present invention, a spark plug is provided which includes a tubular metal shell, an insulator, a cylindrical center electrode, and at least one ground electrode.

The insulator is retained in the metal shell such that an end thereof protrudes from an end of the metal shell.

The center electrode is secured in the insulator and has a protruding portion that protrudes from the end of the insulator.

The ground electrode has an inclined portion, a straight portion, and a bend between the inclined and straight portions. The inclined portion extends obliquely with respect to the axial direction of the center electrode from a base end of the ground electrode, which is joined to the end of the metal shell, to the bend that is positioned closer to the center electrode in the radial direction of the center electrode than the base end. The straight portion extends substantially parallel to the axial direction of the center electrode from the bend to a tip end of the ground electrode. The straight portion has an inner side surface that faces the side surface of an end portion of the protruding portion of the center electrode through a spark gap in the radial direction of the center electrode.

Preferably, the spark plug further includes a noble metal chip that has a length with a base end joined to the inner side surface of the straight portion of the ground electrode and a tip end facing the side surface of the end portion of the protruding portion of the center electrode through the spark gap in the radial direction of the center electrode. Further, in the spark plug, the end portion of the protruding portion of the center electrode has a cross-sectional area perpendicular to the axial direction of the center electrode in a range of 0.79 to 4.9 $mm^2$; the protruding portion of the center electrode has a surface area in a rage of 10 to 30 $mm^2$; the noble metal chip has a cross-sectional area perpendicular to the lengthwise direction of the noble metal chip in a range of 0.12 to 1.13 $mm^2$ and a protruding length, which represents a distance from the inner side surface of the straight portion of the ground electrode to the tip end of the noble metal chip in the radial direction of the center electrode, in a range of 0.3 to 1.5 mm.

Further, in the spark plug, the end portion of the protruding portion of the center electrode preferably includes on the side surface thereof a noble metal portion that faces the noble metal chip through the spark gap in the radial direction of the center electrode.

Both the noble metal chip and the noble metal portion of the center electrode may be made of a Pt-based alloy that includes Pt in an amount of not less than 50% by weight and at least one additive selected from Ir, Rh, Ni, W, Pd, Ru, Re, Al, $Al_2O_3$, Y, and $Y_2O_3$. Otherwise, those may also be made of an Ir-based alloy that includes Ir in an amount of not less than 50% by weight and at least one additive selected from Pt, Rh, Ni, W, Pd, Ru, Re, Al, $Al_2O_3$, Y, and $Y_2O_3$.

Moreover, in the spark plug, the following dimensional relationship is preferably defined:

$$0 \leqq (W-d) \leqq 1.5 \text{ mm},$$

where W is the width of the inner side surface of the straight portion of the ground electrode perpendicular to the axial direction of the center electrode, and d is the diameter of the noble metal chip when it is cylindrical.

Furthermore, the noble metal chip is preferably joined to the inner side surface of the straight portion of the ground electrode by laser welding, so that a weld is formed between the noble metal chip and the inner side surface of the straight portion of the ground electrode over the entire circumference of the noble metal chip.

Preferably, in the spark plug, the inner side surface of the straight portion of the ground electrode has a length in the axial direction of the center electrode in a range of 1.8 to 3.0 mm.

Preferably, in the spark plug, the ratio of g/G is greater than or equal to 1.3, where g is the minimum distance between the ground electrode and the insulator, and G is the size of the spark gap which represents the minimum distance between the center electrode and the noble metal chip.

Preferably, the spark plug includes a plurality of the ground electrodes.

According to another aspect of the present invention, a method of manufacturing a spark plug for an internal combustion engine is provided which includes the steps of:

preparing a tubular metal shell, an assembly of an insulator and a cylindrical center electrode, and at least one ground electrode base material, the center electrode being secured in the insulator and having a protruding portion that protrudes from an end of the insulator, the ground electrode base material being rod-shaped and having a first and a second end that are opposite to each other in the lengthwise direction of the ground electrode base material;

joining the first end of the ground electrode base material to an end of the metal shell such that the lengthwise direction of the ground electrode base material is substantially parallel to the axial direction of the metal shell;

bending the ground electrode base material to move the second end thereof outward in the radial direction of the metal shell, thereby forming a bend between the first and second ends of the ground electrode base material;

joining a noble metal chip by laser welding to the inner side surface of a portion of the ground electrode base material between the bend and the second end;

fitting the assembly of the insulator and the center electrode in the metal shell such that the end of the insulator protrudes from the end of the metal shell and the axial direction of the metal shell substantially coincides with the axial direction of the center electrode; and bending the ground electrode base material at the first end thereof to make the portion thereof between the bend and the second end being substantially parallel to the axial direction of the center electrode and closer to the center electrode in the radial direction of the center electrode than the first end, thereby forming a ground electrode, the ground electrode having an inclined portion, a straight portion, and a bend between the inclined and straight portions which corresponds to the bend of the ground electrode base material, the inclined portion extending obliquely with respect to the axial direction of the center electrode from a base end of the ground electrode, which corresponds to the first end of the ground electrode base material, to the bend, the straight portion extending substantially parallel to the axial direction of the center electrode from the bend to a tip end of the ground electrode which corresponds to the second end of the ground electrode base material, the straight portion having an inner side surface to which is joined the noble metal chip that faces the side surface of the protruding portion of the center electrode through a spark gap in the radial direction of the center electrode.

Preferably, in the method, a plurality of the ground electrodes are formed from a plurality of the ground electrode base materials.

Preferably, in the method, the laser welding for joining the noble metal chip to the inner side surface of the portion of the ground electrode base material is performed by irradiating a laser beam with an irradiation angle with respect to the inner side surface of the portion of the ground electrode base material in a range of 20 to 55°.

Consequently, through providing the above spark plug and the manufacturing method, the objects of the present invention are achieved.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1:
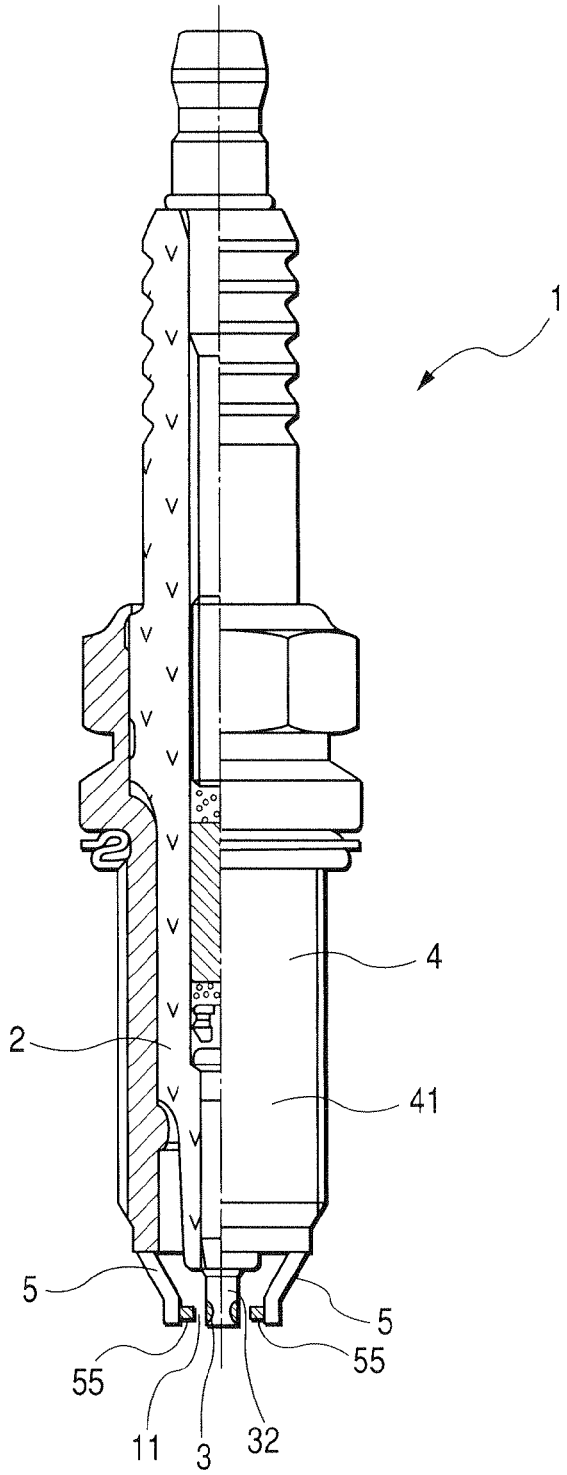
FIG. 1 is a partially cross-sectional view showing the overall structure of a spark plug according to the first embodiment of the invention.

The preferred embodiments of the present invention will be described hereinafter with reference to FIGS. 1-11.

It should be noted that, for the sake of clarity and understanding, identical components having identical functions in different embodiments of the invention have been marked, where possible, with the same reference numerals in each of the figures.

[First Embodiment]

FIG. 1 shows the overall structure of a spark plug 1 according to the first embodiment of the invention.

The spark plug 1 is designed for use in an internal combustion engine of an automotive vehicle or a cogeneration system. Specifically, the spark plug 1 is designed to perform two different functions in the engine. One function is to ignite the air/fuel mixture within a combustion chamber of the engine; the other is to induce and detect an ion current within the combustion chamber of the engine.

As shown in FIG. 1, the spark plug 1 includes an insulator 2, a cylindrical center electrode 3, a tubular metal shell 4, and a pair of ground electrodes 5.

Figure 2:
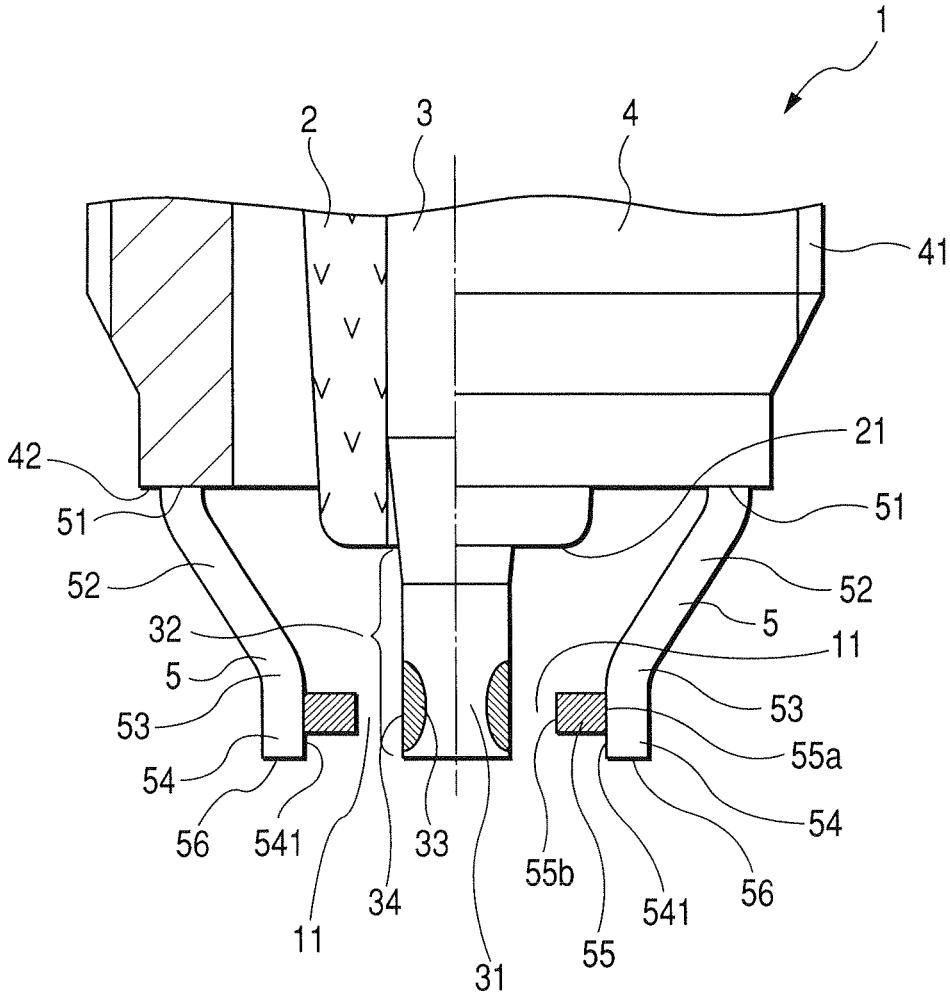
FIG. 2 is an enlarged partially cross-sectional view showing an end portion of the spark plug of FIG. 1.

Referring to FIG. 2, the tubular metal shell 4 has a male threaded portion 41 on an outer periphery thereof, through which the spark plug 1 is installed in the combustion chamber of the engine. The metal shell 4 is made of a conductive metal material, such as low-carbon steel.

The insulator 2 is retained in the metal shell 4 such that an end 21 thereof protrudes from an end 42 of the metal shell 4. The insulator 2 is made, for example, of alumina ($Al_2O_3$).

The cylindrical center electrode 3 is secured in the insulator 2, so that it is electrically isolated from the metal shell 4. The center electrode 3 has a protruding portion 32 that protrudes from the end 21 of the insulator 2. The center electrode 3 may be made of a highly heat conductive metal material such as Cu as the core material and a highly heat-resistant, corrosion-resistant metal material such as a Ni (Nickel)-based alloy as the cladding material.

The two ground electrodes 5 are disposed on the same diameter line of the metal shell 4, with the center electrode 3 interposed therebetween.

Each of the ground electrodes 5 has an inclined portion 52, a straight portion 54, and a bend 53 between the inclined and straight portions 52 and 54. The inclined portion 52 extends obliquely with respect to the axial direction of the center electrode 3 from a base end 51 of the ground electrode 5, which is joined to the end 42 of the metal shell 4 by, for example, resistance welding, to the bend 53 that is poisoned closer to the center electrode 3 in the radial direction of the center electrode 3 than the base end 51.

The straight portion 54 extends substantially parallel to the axial direction of the center electrode 3 from the bend 53 to a tip end 56 of the ground electrode 5. The straight portion 54 has an inner side surface 541 that faces the side surface 34 of an end portion 31 of the center electrode 3 in the radial direction of the center electrode 3. Each of the ground electrodes 5 is made, for example, of a Ni-based alloy.

Further, in the spark plug 1, there is provided a cylindrical noble metal chip 55 on the inner side surface 541 of the straight portion 54 of each of the ground electrodes 5. Specifically, the noble metal chip 55 has base end 55*a*, which is joined to the inner side surface 541 of the straight portion 54 of the ground electrode 5, and a tip end 55*b* that faces the side surface 34 of the end portion 31 of the center electrode 3 through a spark gap 11 in the radial direction of the center electrode 3.

Figure 9:
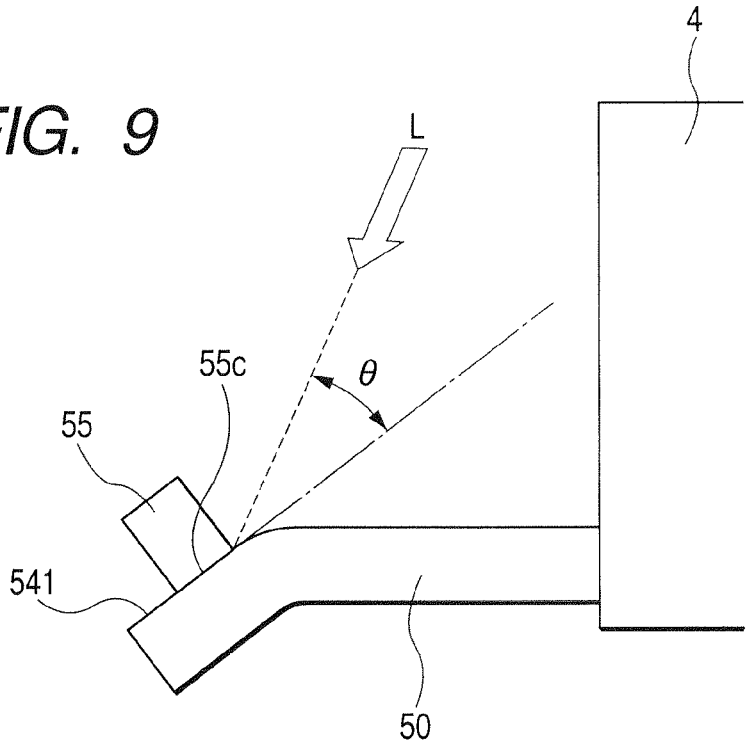
FIG. 9 is a schematic view illustrating an irradiation angle of a laser beam in manufacture of the spark plug of FIG. 1.
Figure 10:
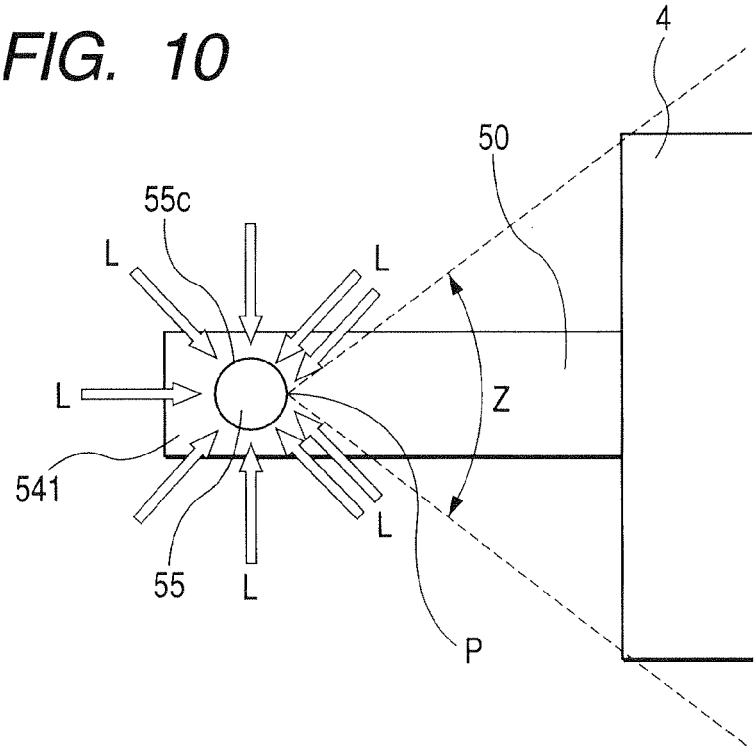
FIG. 10 is a schematic view illustrating irradiation of a laser beam in manufacture of the spark plug of FIG. 1.

As to be described in detail in the following embodiments of the invention, the noble metal chip 55 is joined to the inner side surface 541 of the straight portion 54 of the ground electrode 5 by laser welding, so that a weld 55*c* (as indicated in FIGS. 9 and 10) is formed between the noble metal chip 55 and the inner side surface 541 of the straight portion 54 of the ground electrode 5 over the entire circumference of the noble metal chip 55.

Furthermore, in the spark plug 1, the center electrode 3 includes a pair of noble metal portions 33, which are formed by, for example, swaging on the side surface 34 of the end portion 31 of the center electrode 3 and faces the corresponding inner side surfaces 541 of the straight portions 54 of the ground electrodes 5.

It should be noted that instead of providing such noble metal portions 33, the entire end portion 31 of the center electrode 3 may be made of a noble metal or its alloy.

Preferably, the noble metal chips 55 and the noble metal portions 33 of the center electrode 3 are made of a Pt-based alloy that includes Pt in an amount of not less than 50% by weight and at least one additive selected from Ir, Rh, Ni, W, Pd, Ru, Re, Al, $Al_2O_3$, Y, and $Y_2O_3$. Otherwise, those may also be made of an Ir-based alloy that includes Ir in an amount of not less than 50% by weight and at least one additive selected from Pt, Rh, Ni, W, Pd, Ru, Re, Al, $Al_2O_3$, Y, and $Y_2O_3$.

Using such materials, it is possible to suppress wear of the noble metal chips 55 and the center electrode 3, thereby securing a long service life of the spark plug 1.

Figure 3:
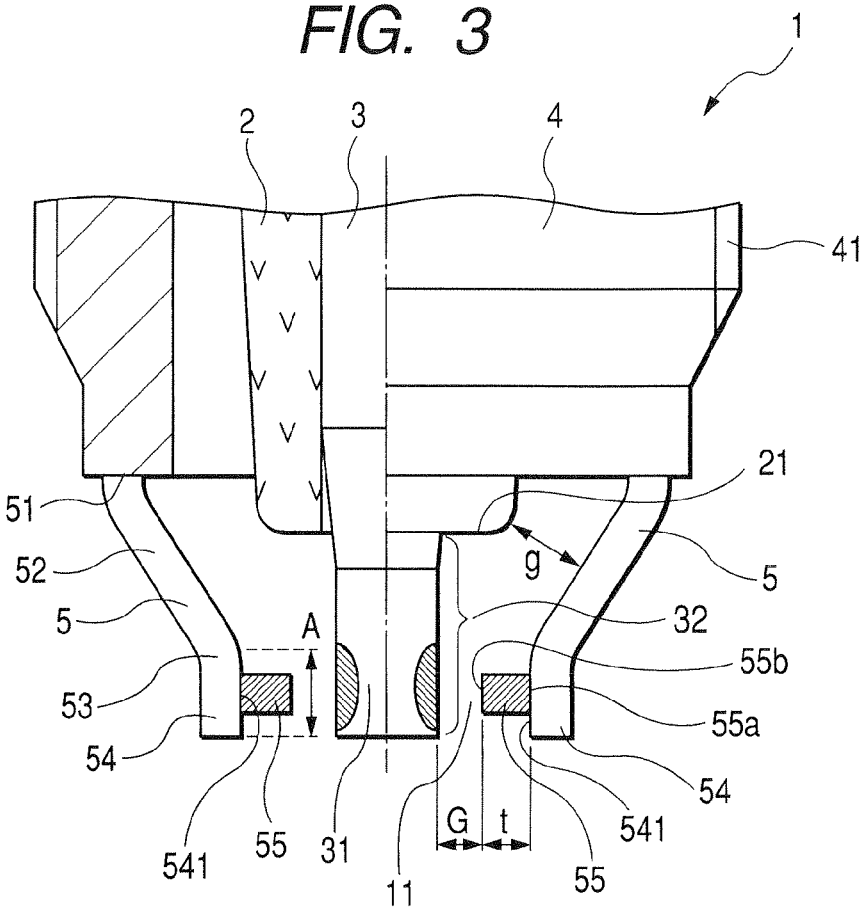
FIG. 3 is an enlarged partially cross-sectional view illustrating dimensional parameters in the spark plug of FIG. 1.
Figure 4:
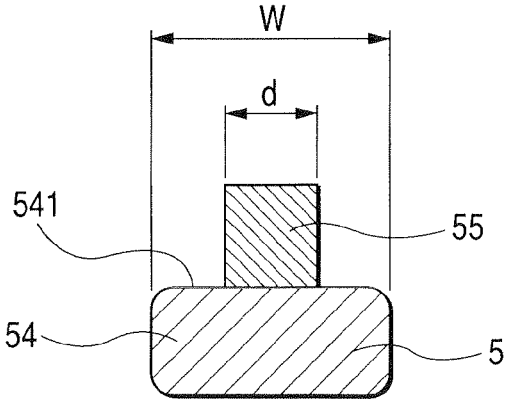
FIG. 4 is a cross-sectional view illustrating a width of a ground electrode and the diameter of a noble metal chip in the spark plug of FIG. 1.

Having described the overall structure of the spark plug 1, the following dimensional parameters, which are critical to the performance of the spark plug 1, will be defined and specified hereinafter with reference to FIGS. 3 and 4.

In the spark plug 1, a cross-sectional area S31 of the end portion 31 of the center electrode 3 perpendicular to the axial direction of the center electrode 3 is in the range of 0.79 to 4.9 $mm^2$.

The surface area S32 of the protruding portion 32 of the center electrode 3 is in the range of 10 to 30 $mm^2$.

The cross-sectional area S55 of each of the noble metal chips 55 perpendicular to the lengthwise direction of the noble metal chip 55 is in the range of 0.12 to 1.13 $mm^2$.

A protruding length t of each of the noble metal chips 55, which is defined as the distance from the inner side surface 541 of the straight portion 54 of the corresponding ground electrode 5 to the tip end 55*b* of the noble metal chip 55 in the radial direction of the center electrode 3, is in the range of 0.3 to 1.5 mm.

The length A of the inner side surface 541 of the straight portion 54 of each of the ground electrodes 5 in the axial direction of the center electrode 3 is in the range of 1.8 to 3.0 mm.

The ratio of g/G is greater than or equal to 1.3, where g is the minimum distance between the ground electrodes 5 and the insulator 2, and G is the size of the spark gaps 11 which represents the minimum distance between the noble metal chips 55 and the center electrode 3.

The width W of the inner side surfaces 541 of the straight portions 54 of the ground electrodes 5 perpendicular to the axial direction of the center electrode 3 and the diameter d of the noble metal chips 55 have the following relationship:

$0 \leqq (W-d) \leqq 1.5$ mm.

The above-described spark plug 1 according to the present embodiment has the following advantages.

In the spark plug 1, each of the ground electrodes 5 includes the inclined portion 52, the straight portion 54, and the bend 53 between the inclined and straight portions 52 and 54. The straight portion 54 has the inner side surface 541 that faces the side surface 34 of the end portion 31 of the center electrode 3 in the radial direction of the center electrode 3.

With such a configuration, the space between the protruding portion 32 of the center electrode 3 and the ground electrodes 5 becomes small, so that sparks can be discharged in a wide range between the protruding portion 32 of the center electrode 3 and the ground electrodes 5.

Consequently, when the surface of the protruding portion 32 of the center electrode 3 is fouled with combustion residues, it is possible to burn off in a sufficiently wide range the combustion residues, thereby securing a sufficiently large effective area of the surface which can absorb ions created within the combustion chamber of the engine. As a result, it becomes possible for the spark plug 1 to reliably induce and detect the ion current as described above within the combustion chamber of the engine.

Further, in the spark plug 1, the cross-sectional area S31 of the end portion 31 of the center electrode 3 is specified to the range of 0.79 to 4.9 $mm^2$, the surface area S32 of the protruding portion 32 of the center electrode 3 is specified to the range of 10 to 30 $mm^2$, the cross-sectional area S55 of the noble metal chips 55 is specified to the range of 0.12 to 1.13 $mm^2$, and the protruding length t of the noble metal chips 55 is specified to the range of 0.3 to 1.5 mm.

With such specifications, it is possible to secure a superior capability of the spark plug 1 to reliably induce and detect the ion current within the combustion chamber of the engine as well as a superior ignition capability (i.e., the capability to ignite the air/fuel mixture within the combustion chamber of the engine) of the spark plug 1.

Specifically, through specifying the cross-sectional area S31 of the end portion 31 of the center electrode 3 and the surface area S32 of the protruding portion 32 of the center electrode 3 to the above ranges, it becomes possible to secure a sufficiently large effective area of the surface of the protruding portion 32 even when the surface remains partially fouled with combustion residues after spark discharges. At the same time, it also becomes possible to prevent the heat capacity of the center electrode 3 from becoming too large, thereby securing a high ignition capability of the spark plug 1.

If the cross-sectional area S31 of the end portion 31 of the center electrode 3 is below 0.79 $mm^2$, it may be difficult to secure a superior capability of the spark plug 1 to reliably induce and detect the ion current within the combustion chamber of the engine. On the contrary, if the cross-sectional area S31 is above 4.9 $mm^2$, it may be difficult to secure a superior ignition capability of the spark plug 1.

If the surface area S32 of the protruding portion 32 of the center electrode 3 is below 10 $mm^2$, it may be difficult to secure a superior capability of the spark plug 1 to reliably induce and detect the ion current within the combustion chamber of the engine. On the contrary, if the surface area S32 is above 30 $mm^2$, it may be difficult to secure a superior ignition capability of the spark plug 1.

Through specifying the cross-sectional area S55 and the protruding length t of the noble metal chips 55 to the above ranges, it becomes possible to secure a superior heat-resistant and wear-resistant capability of the noble metal chips 55. At the same time, it also becomes possible to prevent the heat capacity of the noble metal chips 55 from becoming too large, thereby securing a high ignition capability of the spark plug 1.

If the cross-sectional area S55 of the noble metal chips 55 is below 0.12 $mm^2$, it may be difficult to secure a superior heat-resistant and wear-resistant capability of the noble metal chips 55. On the contrary, if the cross-sectional area S55 is above 1.13 $mm^2$, it may be difficult to secure a high ignition capability of the spark plug 1.

If the protruding length t of the noble metal chips 55 is below 0.3 mm, it may be difficult to secure a high ignition capability of the spark plug 1. On the contrary, if the protruding length t is above 1.5 mm, it may be difficult to secure a superior heat-resistant and wear-resistant capability of the noble metal chips 55.

In the spark plug 1, the length A of the inner side surfaces 541 of the straight portions 54 of the ground electrodes 5 in the axial direction of the center electrode 3 is specified to the range of 1.8 to 3.0 mm.

With such a specification, it is possible to clean in a sufficiently wide range the surface of the protruding portion 32 of the center electrode 3, thereby securing a sufficiently large effective area of the surface. As a result, it becomes possible to improve the capability of the spark plug 1 to reliably induce and detect the ion current within the combustion chamber of the engine.

If the length A is below 1.8 mm, it may be difficult to clean in a sufficiently wide range the surface of the protruding portion 32 of the center electrode 3. As a result, it would become difficult to prevent the effective area of the surface from decreasing with running of the engine. On the contrary, if the length A is above 3.0 mm, "side sparks" may occur instead of "normal sparks", so that the induced combustion would become unstable and thus could not create a sufficient number of ions necessary for inducing the ion current.

Hereinafter, the side sparks denote sparks which move from the center electrode 3 along the end 21 of the insulator 2 and jump to the inclined portions 52 of the ground electrodes 5. In comparison, normal sparks denote sparks which are discharged across the spark gaps 11.

In the spark plug 1, the ratio of g/G is specified to be greater than or equal to 1.3.

Figure 12:
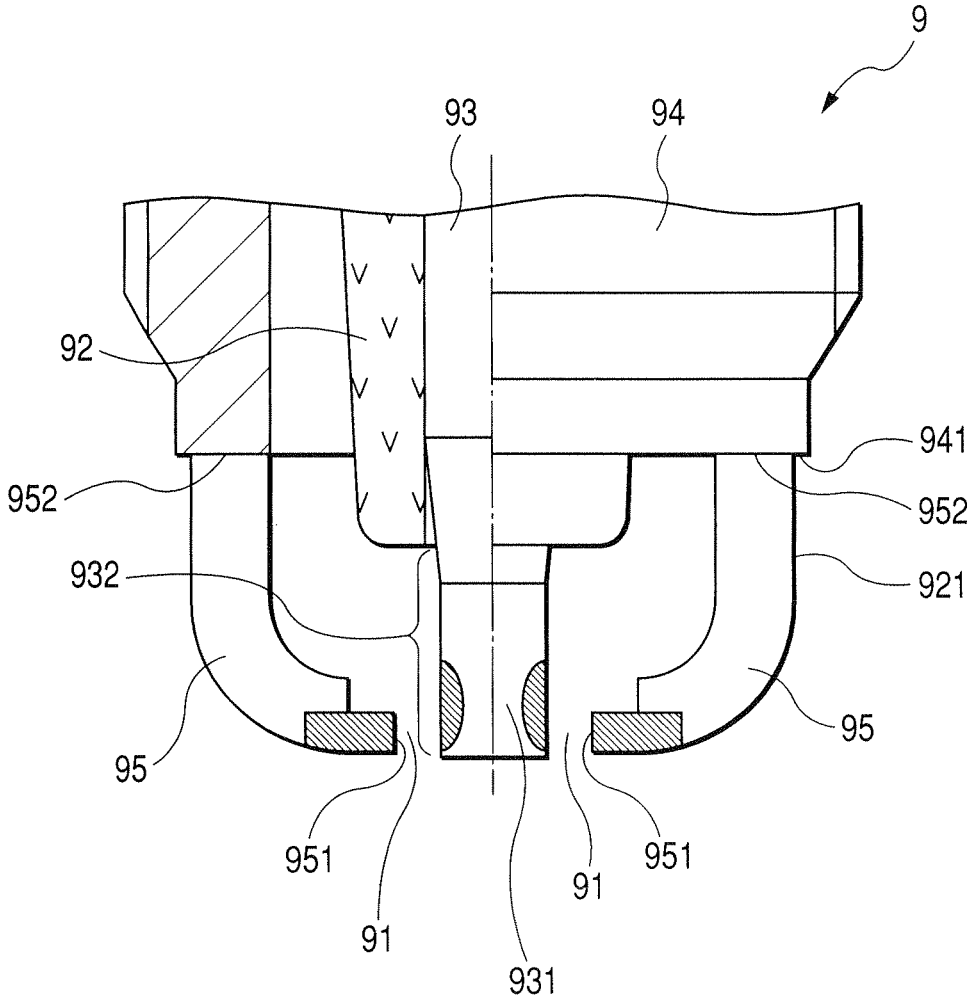
FIG. 12 (PRIOR ART)
FIG. 12 is an enlarged partially cross-sectional view showing an end portion of a prior art spark plug.

Specifically, in the spark plug 1, it is easier to make the ground electrodes 5 too close to the insulator 2 than in the existing spark plug 9 shown in FIG. 12. However, through specifying the ratio of g/G as above, it becomes possible to effectively suppress occurrence of side sparks, thereby securing the combustion efficiency within the combustion chamber of the engine.

In the spark plug 1, the width W of the inner side surfaces 541 of the straight portions 54 of the ground electrodes 5 and the diameter d of the noble metal chips 55 are specified to have the relationship of $0 \leqq (W-d) \leqq 1.5$ mm.

Through specifying such a relationship, in laser welding of the noble chips 55 to the corresponding inner side surfaces 541, a laser beam can be easily and reliably irradiated to the joining portions thereof, thereby securing high welding quality.

If $(W-d) > 1.5$ mm, it may be difficult to irradiate the laser beam with a suitable irradiation angle to the joining portions over the entire circumference thereof. On the contrary, if $(W-d) < 0$, the noble metal chips 55 would protrude from the corresponding inner side surfaces 541. In both the cases, it would be difficult to secure high welding quality.

In the spark plug 1, there is formed the weld 55*c* between each of the noble metal chips 55 and the inner side surface 541 of the straight portion 54 of the corresponding ground electrode 5 over the entire circumference of the noble metal chip 5.

Consequently, the weld strength between the noble metal chips 55 and the corresponding inner side surfaces 541 are secured.

In the spark plug 1, there is provided more than one ground electrode 5. With the increased number of ground electrodes 5, it becomes possible to more reliably clean the surface of the protruding portion 32 of the center electrode 3, thereby improving the capability of the spark plug 1 to induce and detect the ion current within the combustion chamber of the engine.

The above-described advantages of the spark plug 1 have been confirmed through the experiments to be described below.

Experiment 1

This experiment was conducted to determine the effect of the protruding length t of the noble metal chips 55 on the ignition capability of the spark plug 1.

In the experiment, four different types A, B, C, and D of sample spark plugs were used, and two different protruding lengths t of 0.3 mm and 0.8 mm were used for each of the four types.

Specifically, in sample spark plugs of the type A, the diameter of the center electrode 3 was 2.5 mm, the cross-sectional area S31 of the end portion 31 of the center electrode 3 was 4.9 $mm^2$, the surface area S32 of the protruding portion 32 of the center electrode 3 was 30 $mm^2$, the diameter d of the noble metal chips 55 was 1.2 mm, and the cross-sectional area S55 of the noble metal chips 55 was 1.13 $mm^2$.

In sample spark plugs of the type B, the diameter of the center electrode 3 was 2.5 mm, the cross-sectional area S31 of the end portion 31 of the center electrode 3 was 4.9 $mm^2$, the surface area S32 of the protruding portion 32 of the center electrode 3 was 30 $mm^2$, the diameter d of the noble metal chips 55 was 0.4 mm, and the cross-sectional area S55 of the noble metal chips 55 was 0.12 $mm^2$.

In sample spark plugs of the type C, the diameter of the center electrode 3 was 2.0 mm, the cross-sectional area S31 of the end portion 31 of the center electrode 3 was 3.1 $mm^2$, the surface area S32 of the protruding portion 32 of the center electrode 3 was 21 $mm^2$, the diameter d of the noble metal chips 55 was 1.2 mm, and the cross-sectional area S55 of the noble metal chips 55 was 1.13 $mm^2$.

In sample spark plugs of the type D, the diameter of the center electrode 3 was 2.0 mm, the cross-sectional area S31 of the end portion 31 of the center electrode 3 was 3.1 $mm^2$, the surface area S32 of the protruding portion 32 of the center electrode 3 was 21 $mm^2$, the diameter d of the noble metal chips 55 was 0.4 mm, and the cross-sectional area S55 of the noble metal chips 55 was 0.12 $mm^2$.

All the sample spark plugs were tested using an internal combustion engine, which has a displacement of 1.8 L and four in-line cylinders, under idling condition. The ignition capability of the sample spark plugs was evaluated in terms of lean limit air/fuel ratio.

Figure 5:
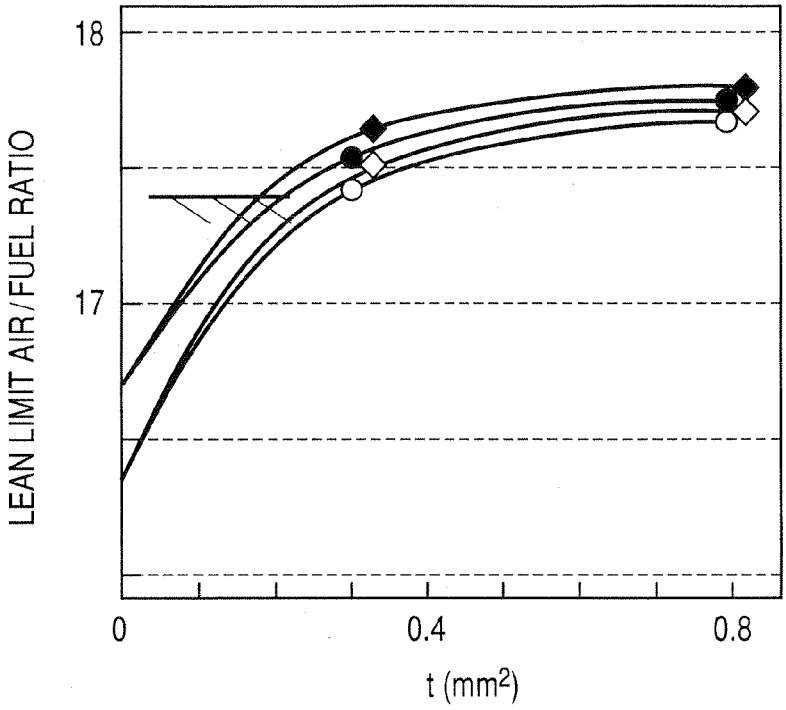
FIG. 5 is a graphical representation showing the relationship between the protruding length of ground electrodes and the ignition capability of the spark plug of FIG. 1.

FIG. 5 shows the test results, where the plots of "○" indicate the results with the sample spark plugs of type A, the plots of "◇" indicate the results with the sample spark plugs of type B, the plots of "●" indicate the results with the sample spark plugs of type C, and the plots of "◆" indicate the results with the sample spark plugs of type D.

It can be seen from FIG. 5 that when the protruding length t of the noble metal chips 55 was greater than or equal to 0.3 mm, the lean limit air/fuel ratio was greater than or equal to 17.4 for all the sample spark plug types.

In other words, a high ignition capability of the spark plug 1 is secured through specifying the protruding length t of the noble metal chips 55 to be not less than 0.3 mm.

Experiment 2

This experiment was conducted to investigate the change in the effective area of the surface of the protruding portion 32 of the center electrode 3 with mileage.

Four different types A, B, C, and D of sample spark plugs were used in the experiment. Specifically, sample spark plugs of the types A-C were fabricated according to the present invention, in each of which the cross-sectional area S31 of the end portion 31 of the center electrode 3 was 3.1 $mm^2$, the surface area S32 of the protruding portion 32 of the center electrode 3 was 25 $mm^2$, the cross-sectional area S55 of the noble metal chips 55 was 0.38 $mm^2$, and the protruding length t of the noble metal chips 55 was 0.8 mm. The length A of the inner side surfaces 541 of the straight portions 54 of the ground electrodes 5 was 1.3 mm for the sample spark plug of type A, 1.8 mm for that of type B, and 2.3 mm for that of type C. On the other hand, the type D was the existing one as shown in FIG. 12.

All the sample spark plugs were tested using an internal combustion engine of an automotive vehicle, which has a displacement of 2 L and six in-line cylinders.

Figure 6:
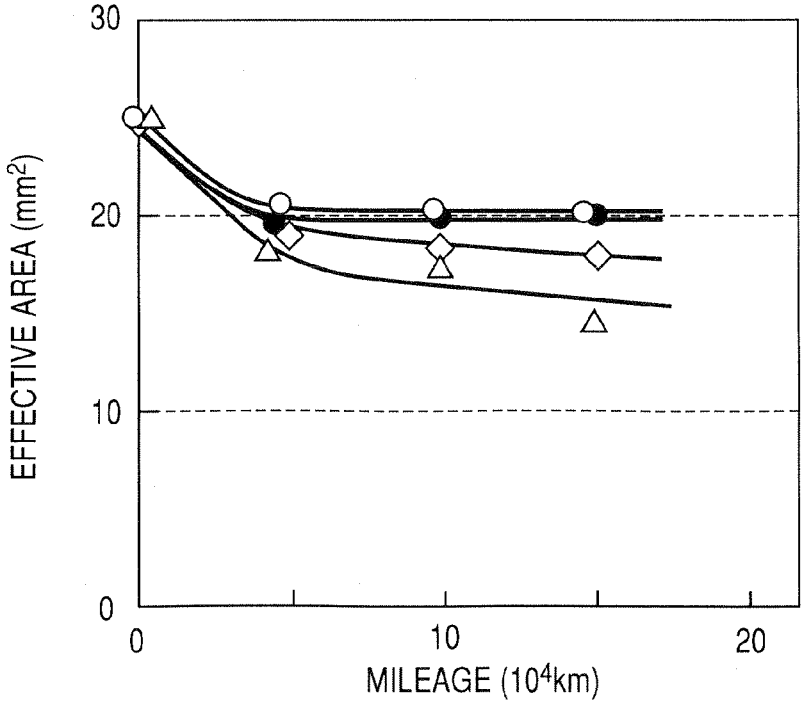
FIG. 6 is a graphical representation showing the relationship between the effective area of a center electrode of the spark plug of FIG. 1 and mileage.

FIG. 6 shows the test results, where the plots of "◇" indicate the results with the sample spark plug of type A, the plots of "●" indicate the results with the sample spark plug of type B, the plots of "○" indicate the results with the sample spark plug of type C, and the plots of "Δ" indicate the results with the sample spark plug of type D.

It can be seen from FIG. 6 that with increase in mileage, the effective area of the surface of the protruding portion 32 of the center electrode 3 decreased much more slowly in the sample spark plugs of types A-C than in the sample spark plug of type D. Especially, in the case of types B and C, the effective area of the surface decreased only in early stage of the running and kept almost constant thereafter.

In other words, through specifying the length A of the inner side surfaces 541 of the straight portions 54 of the ground electrodes 5 to be not less than 1.8 mm, a sufficiently large effective area of the surface is secured in the spark plug 1, thus ensuring a superior capability of the spark plug 1 to induce and detect the ion current.

Experiment 3

This experiment was conducted to determine the effect of the ratio of g/G on the occurrence rate of side sparks in the spark plug 1.

Five different sample spark plugs were used in the experiment, in which the ratios of g/G were 1.0, 1.1, 1.2, 1.3, and 1.8, respectively.

All the sample spark plugs were tested using an internal combustion engine, which has a displacement of 1.8 L and four in-line cylinders, under idling condition.

During the test, the determination as to whether a discharged spark is a normal or a side spark was made based on the waveform of the discharged spark. Further, the occurrence rate of side sparks for a sample spark plug was determined as the ratio of the number of occurrence of side sparks to the total number of occurrence of normal and side sparks in that sample spark plug.

Figure 7:
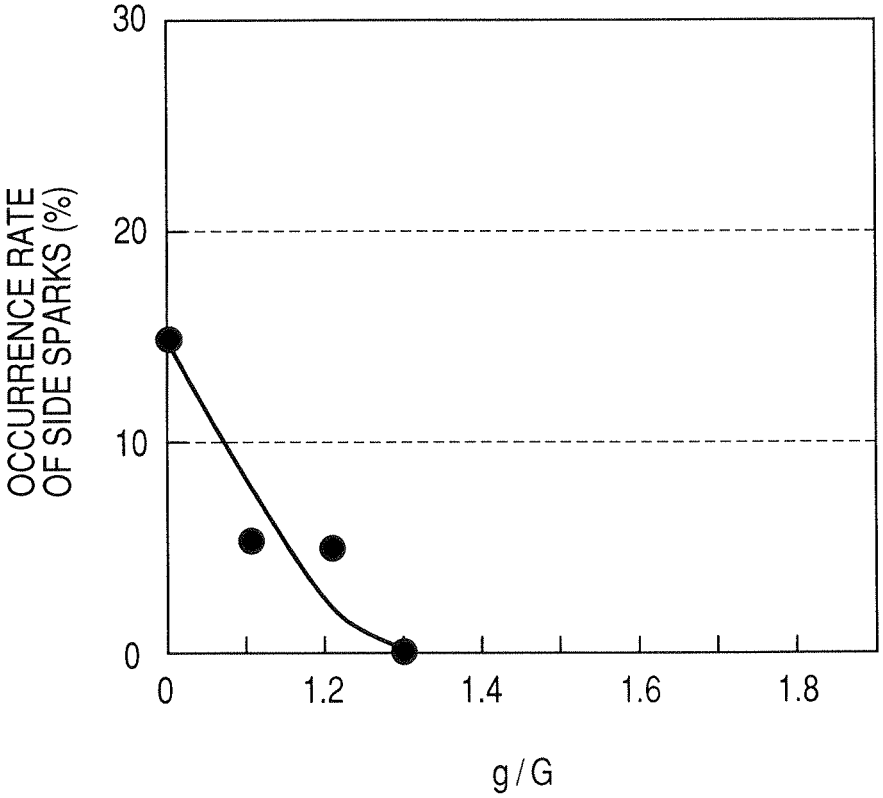
FIG. 7 is a graphical representation showing the relationship between a dimensional parameter g/G and the occurrence rate of side sparks in the spark plug of FIG. 1.

FIG. 7 shows the test results, where the horizontal axis represents the ratio of g/G, while the vertical one represents the occurrence rate of side sparks.

It can be seen from FIG. 7 that the occurrence rate of side sparks decreased with increase in the ratio of g/G, and occurrence of side sparks was completely suppressed with the ratio of g/G being greater than or equal to 1.3.

In other words, through specifying the ratio of g/G to be greater than or equal to 1.3 mm, side sparks are prevented from occurring in the spark plug 1.

[Second Embodiment]

This embodiment illustrates a method of manufacturing the spark plug 1 described in the previous embodiment.

According to the method, the metal shell 4 and a pair of ground electrode base materials 50 for forming the ground electrodes 5 are first prepared.

Each of the ground electrode base materials 50 is rod-shaped and has a first end 50*a* and a second end 50*b* which are opposite to each other in the lengthwise direction of the ground electrode base material 50.

Figure 8A:
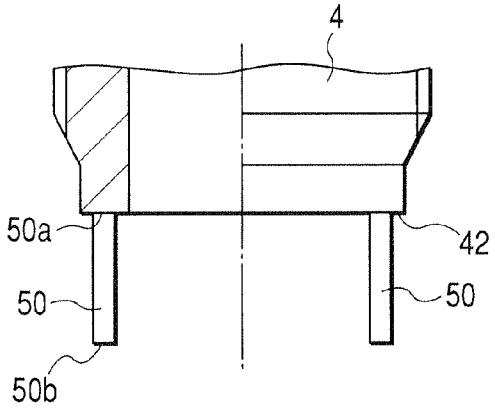
FIGS. 8A-8D are schematic views illustrating a method, according to the second embodiment of the invention, of manufacturing the spark plug of FIG. 1.

Secondly, as shown in FIG. 8A, the first end 50*a* of each of the ground electrode base materials 50 is joined by, for example, resistance welding to the end 42 of the metal shell 4.

Figure 8B:
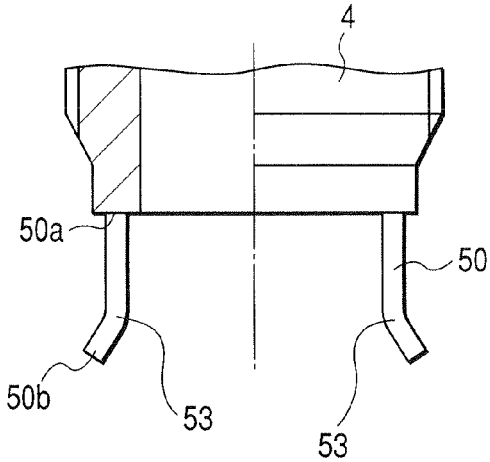

Thirdly, as shown in FIG. 8B, each of the ground electrode base materials 50 is bent to move the second end 50*b* outward in the radial direction of the metal shell 4, thereby forming the bend 53 between the first end 50*a* and the second end 50*b*.

Figure 8C:
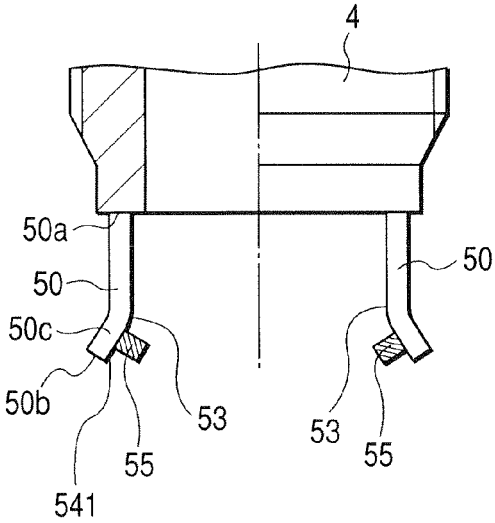

Fourthly, as shown in FIG. 8C, the noble metal chip 55 is joined by laser welding to the inner side surface 541 of a portion 50*c* of each of the ground electrode base materials 50 between the bend 53 and the second end 50*b*.

Fifthly, an assembly of the insulator 2 and the center electrode 3 is prepared and fitted in the metal shell 4.

Sixthly, each of the ground electrode base materials 50 is bent at the first end 50*a* to make the portion 50*c* being parallel to the axial direction of the center electrode 3 and closer to the center electrode 3 in the radial direction of the center electrode 3 than the first end 50*a*, thereby forming the ground electrode 5.

Figure 8D:
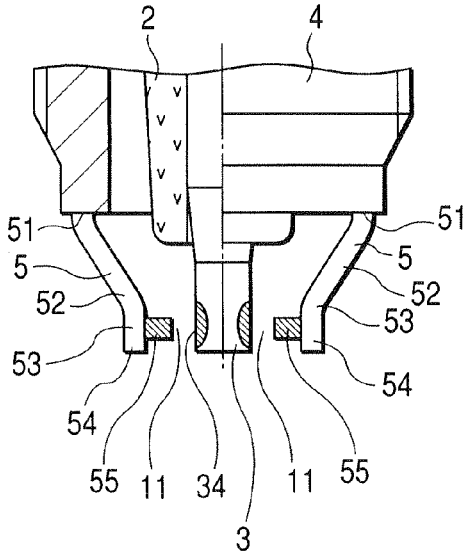

As a result, the spark plug 1 according to the previous embodiment is finally obtained, as shown in FIG. 8D. It should be noted that in the above method, the fifth step of fitting the assembly of the insulator 2 and the center electrode 3 in the metal shell 4 may be arranged after the sixth step of forming the ground electrodes 5. In addition, the noble metal chips 55 may be temporally joined by, for example, resistance welding to the corresponding ground electrode base materials 50 before the fourth step of laser welding.

In the fourth step of the above method, referring to FIG. 9, a laser beam L is irradiated with an irradiation angle θ with respect to the inner side surface 541 of the ground electrode base material 50 in the range of 20 to 55°.

Referring further to FIG. 10, the laser beam L is irradiated to the joining portions of the noble metal chip 55 and the ground electrode base material 50 over the entire circumference of the noble metal chip 55.

In this case, however, there exists a dead zone Z, in which the metal shell 4 hinders irradiating the laser beam L perpendicularly with respect to the circumference of the noble metal chip 55 to the welding point P that is closest to the metal shell 4. Therefore, to the welding point P, the laser beam L is irradiated obliquely with respect to the circumference of the noble metal chip 55.

The above-described method of manufacturing the spark plug 1 has the following advantages.

According to the method, the fourth step of laser welding is arranged after the third step of bending the ground electrode base materials 50 and before the fifth step of fitting the assembly of the insulator 2 and the center electrode 3 in the metal shell 4.

With such an arrangement, the laser welding of each of the noble metal chips 55 to a corresponding one of the ground electrode base materials 50 will not be hindered by the metal shell 4, the center electrode 3, the insulator 2, and the other ground electrode base material 50. Consequently, it becomes easy to perform the laser welding over the entire circumference of the noble metal chip 55.

Further, according to the method, it becomes easy to adjust the size G of the spark gaps 11 due to the arrangement of the sixth step of forming the ground electrodes 5 after the fourth step of laser welding and the fifth step of fitting.

Furthermore, according to the method, in the fourth step of laser welding, the irradiation angle θ of the laser beam L with respect to the inner side surface 541 of the ground electrode base material 50 is specified to the range of 20 to 55°.

With such a specification, it becomes possible to easily and reliably irradiate the laser beam L to the joining portions of the noble metal chip 55 and the inner side surface 541 of the ground electrode base material 50, thereby enhancing the strength of the laser welding.

If the irradiation angle θ of the laser beam L is below 20°, it may be difficult to prevent the ground electrode base material 50 from being damaged by the laser beam L and to sufficiently melt the joining portion of the ground electrode base material 50. On the contrary, if the irradiation angle θ of the laser beam L is above 55°, it may be difficult to prevent the noble metal chip 55 from being damaged by the laser beam L and to sufficiently melt the joining portion of the noble metal chip 55.

The above range of the irradiation angle θ of the laser beam L has been determined through the experiment to be described below.

Experiment 4

This experiment was conducted to determine the effects of the irradiation angle θ of the laser beam L and the width W of the inner side surfaces 541 of the ground electrodes 5 on the quality of the laser welding.

In the experiment, the irradiation angle θ was varied in the range of 10 to 60° and the width W was varied in the range of 1.4 to 2.6 mm, as shown in TABLE 1. Moreover, the diameter d of the noble metal chips 55 was 0.7 mm, and the distance from the end 42 of the metal shell 4 to the centers of the noble metal chips 55 was 3.8 mm.

TABLE 1

| | W (mm) | | | |
|---|---|---|---|---|
| θ (°) | 1.4 | 1.8 | 2.2 | 2.6 |
| 10 | Δ | x | x | x |
| 20 | ○ | ○ | ○ | Δ |
| 45 | ○ | ○ | ○ | x |
| 50 | ○ | ○ | ○ | x |
| 55 | ○ | ○ | ○ | x |
| 60 | x | x | x | x |

The experiment results are also shown in TABLE 1, where the plots of "○" indicate good welding, the plots of "Δ" indicate somewhat defective welding, and the plots of "x" indicate defective welding. The defective welding includes, for example, occurrence of damage to the noble metal chip 55 or to the ground electrode 5 and irradiation of the laser beam L to only one of the two mating members.

It can bee seen from TABLE 1 that when the irradiation angle θ was in the range of 20 to 55° and the width W was not greater than 2.2 mm, the resultant welding was good.

However, in the case of the irradiation angle θ being equal to 60°, the resultant welding was defective due to occurrence of damage to the noble metal chip 55 or irradiation of the laser beam L only to the ground electrode 5. On the contrary, in the case of the irradiation angle θ being equal to 10°, the resultant welding was defective due to occurrence of damage to the ground electrode 5 or irradiation of the laser beam L only to the noble metal chip 55.

The above defectivenesses in the laser welding can be considered as being caused by unsuitable values of (W−d). Accordingly, based on such a consideration, a suitable range of (W−d) for achieving good welding can be determined as not greater than 1.5 mm (i.e., (2.2-0.7) mm).

Consequently, it has been made obvious from the experiment that good welding can be achieved through specifying the irradiation angle θ to the range of 20 to 55° and the difference of (W−d) to be not greater than 1.5 mm.

Third Embodiment

Though the spark plug 1 can be advantageously manufactured by the method of the previous embodiment, it can also be manufactured by other methods such as the one to be described below.

According to the method of this embodiment, the metal shell 4 and a pair of ground electrode base materials 50 for forming the ground electrodes 5 are first prepared.

Each of the ground electrode base materials 50 is rod-shaped and has a first end 50*a* and a second end 50*b* which are opposite to each other in the lengthwise direction of the ground electrode base material 50.

Figure 11A:
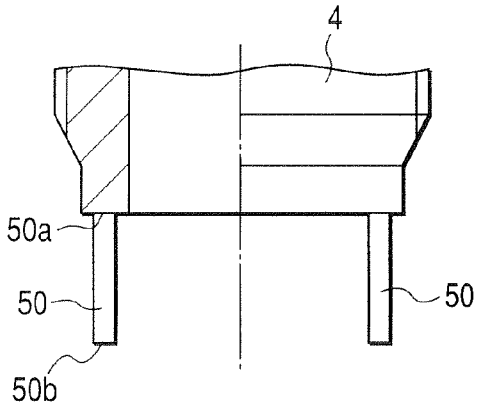
FIGS. 11A-11D are schematic views illustrating a method, according to the third embodiment of the invention, of manufacturing the spark plug of FIG. 1.

Secondly, as shown in FIG. 11A, the first end 50*a* of each of the ground electrode base materials 50 is joined by, for example, resistance welding to the end 42 of the metal shell 4.

Figure 11B:
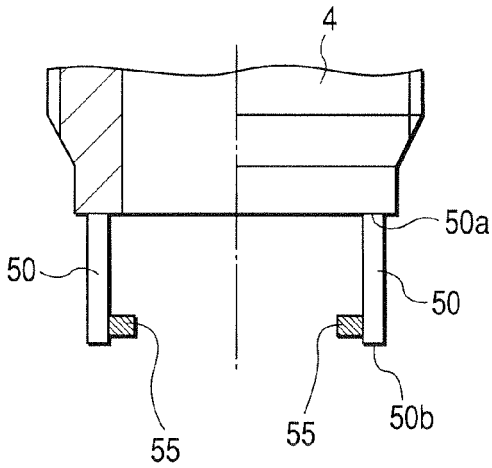

Thirdly, as shown in FIG. 11B, the noble metal chip 55 is joined by laser welding to the inner side surface of each of the ground electrode base materials 50 close to the second end 50*b*.

Figure 11C:
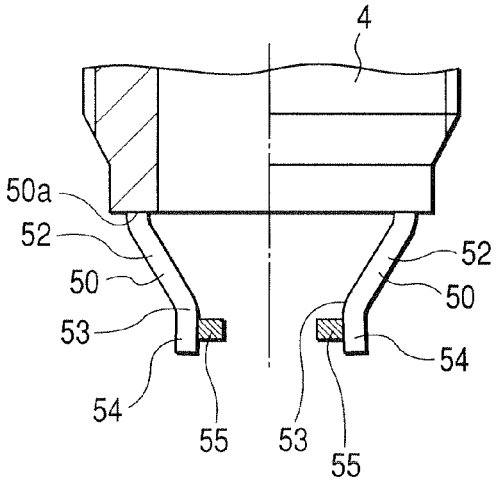

Fourthly, as shown in FIG. 11C, each of the ground electrode base materials 50 is bent at the first end 50*a* inward in the radial direction of the metal shell 4 to form the inclined portion 52 and at a position corresponding to the bend 53 to form the straight portion 54. Consequently, the ground electrodes 5 are obtained.

Fifthly, an assembly of the insulator 2 and the center electrode 3 is prepared and fitted in the metal shell 4.

Figure 11D:
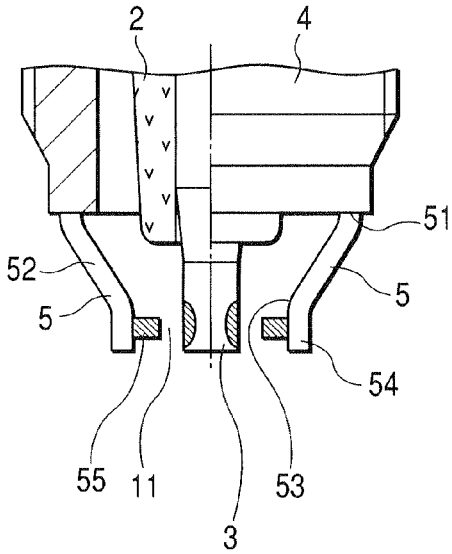

As a result, the spark plug 1 is finally obtained, as shown in FIG. 11D.

The method of the present embodiment has the advantage of including only one bending step, thereby simplifying the manufacturing process of the spark plug 1.

While the above particular embodiments of the invention have been shown and described, it will be understood by those who practice the invention and those skilled in the art that various modifications, changes, and improvements may be made to the invention without departing from the spirit of the disclosed concept.

Such modifications, changes, and improvements within the skill of the art are intended to be covered by the appended claims.

What is claimed is:

1. A method of manufacturing a spark plug for an internal combustion engine comprising the steps of:

preparing a tubular metal shell, an assembly of an insulator and a cylindrical center electrode, and at least one ground electrode base material, said center electrode being secured in said insulator and having a protruding portion that protrudes from an end of said insulator, said ground electrode base material being rod-shaped and having a first and a second end that are opposite to each other in a lengthwise direction of said ground electrode base material;

joining the first end of said ground electrode base material to an end of said metal shell such that the lengthwise direction of said ground electrode base material is substantially parallel to an axial direction of said metal shell;

bending said ground electrode base material to move the second end thereof outward in a radial direction of said metal shell, thereby forming a bend between the first and second ends of said ground electrode base material;

joining a noble metal chip by laser welding to an inner side surface of a portion of said ground electrode base material between the bend and the second end;

fitting the assembly of said insulator and said center electrode in said metal shell such that the end of said insulator protrudes from the end of said metal shell and the axial direction of said metal shell substantially coincides with an axial direction of said center electrode; and bending said ground electrode base material at the first end thereof to make the portion thereof between the bend and the second end being substantially parallel to the axial direction of said center electrode and closer to the center electrode in a radial direction of said center electrode than the first end, thereby forming a ground electrode, said ground electrode having an inclined portion, a straight portion, and a bend between the inclined and straight portions which corresponds to the bend of said ground electrode base material, the inclined portion extending obliquely with respect to the axial direction of said center electrode from a base end of said ground electrode, which corresponds to the first end of said ground electrode base material, to the bend, the straight portion extending substantially parallel to the axial direction of said center electrode from the bend to a tip end of said ground electrode which corresponds to the second end of said ground electrode base material, the straight portion having an inner side surface to which is joined said noble metal chip that faces a side surface of the protruding portion of said center electrode through a spark gap in the radial direction of said center electrode.

2. The method as set forth in claim 1, wherein a plurality of said ground electrodes are formed from a plurality of said ground electrode base materials.

3. The method as set forth in claim 1, wherein the laser welding for joining said noble metal chip to the inner side surface of the portion of said ground electrode base material is performed by irradiating a laser beam with an irradiation angle with respect to the inner side surface of the portion of said ground electrode base material in a range of 20 to 55°.

4. A method of manufacturing a spark plug for an internal combustion engine comprising the steps of:

preparing a tubular metal shell, an assembly of an insulator and a cylindrical center electrode, and at least one ground electrode base material, said center electrode being secured in said insulator and having a protruding portion that protrudes from an end of said insulator, said ground electrode base material being rod-shaped and having a first and a second end that are opposite to each other in a lengthwise direction of said ground electrode base material;

joining the first end of said ground electrode base material to an end of said metal shell such that the lengthwise direction of said ground electrode base material is substantially parallel to an axial direction of said metal shell;

bending said ground electrode base material to move the second end thereof outward in a radial direction of said metal shell, thereby forming a bend between the first and second ends of said ground electrode base material;

joining a noble metal chip by laser welding to an inner side surface of a portion of said ground electrode base material between the bend and the second end;

bending said ground electrode base material at the first end thereof to make the portion thereof between the bend and the second end being substantially parallel to the axial direction of said metal shell and closer to an axis of said metal shell than the first end, thereby forming a ground electrode, said ground electrode having an inclined portion, a straight portion, and a bend between the inclined and straight portions which corresponds to the bend of said ground electrode base material, the inclined portion extending obliquely with respect to the axial direction of said metal shell from a base end of said ground electrode, which corresponds to the first end of said ground electrode base material, to the bend, the straight portion extending substantially parallel to the axial direction of said metal shell from the bend to a tip end of said ground electrode which corresponds to the second end of said ground electrode base material, the straight portion having an inner side surface to which is joined said noble metal chip; and fitting the assembly of said insulator and said center electrode in said metal shell, so that the end of said insulator protrudes from the end of said metal shell and a side surface of the protruding portion of said center electrode faces the noble metal chip through a spark gap in a radial direction of said center electrode.

5. The method as set forth in claim 4, wherein a plurality of said ground electrodes are formed from a plurality of said ground electrode base materials.

6. The method as set forth in claim 4, wherein the laser welding for joining said noble metal chip to the inner side surface of the portion of said ground electrode base material is performed by irradiating a laser beam with an irradiation angle with respect to the inner side surface of the portion of said ground electrode base material in a range of 20 to 55°.

* * * * *